United States Patent [19]

Dziubakowski

[11] 4,454,840

[45] Jun. 19, 1984

[54] ENHANCED SOOTBLOWING SYSTEM

[75] Inventor: Donald J. Dziubakowski, Seven Hills, Ohio

[73] Assignee: The Babcock & Wilcox Company, New Orleans, La.

[21] Appl. No.: 502,906

[22] Filed: Jul. 14, 1983

[51] Int. Cl.[3] ..... F22B 37/52

[52] U.S. Cl. ..... 122/390; 15/316 A; 122/379; 122/391; 122/392

[58] Field of Search ..... 122/379, 390, 391, 392; 15/316 A

[56] References Cited

U.S. PATENT DOCUMENTS

| | | | |
|---|---|---|---|
| 2,948,013 | 8/1960 | Bearer, Jr. | 15/316 A |
| 3,396,706 | 8/1968 | Rayburn | 122/390 X |
| 4,085,438 | 4/1978 | Butler | 122/392 X |
| 4,399,773 | 8/1983 | Schwade et al. | 122/390 |

*Primary Examiner*—Edward G. Favors

*Attorney, Agent, or Firm*—Vytas R. Matas; Robert J. Edwards

[57] ABSTRACT

A method of identifying a parameter of a model for a rate of loss of boiler efficiency due to a sootblowing operation, in a boiler or other convection heat transfer device having a plurality of heat traps, comprises measuring a time since a last sootblowing operation in the heat trap in question, measuring an overall boiler efficiency at the beginning of sootblowing for the heat trap in question, measuring a change in efficiency due to the sootblowing operation and calculating the parameter using an equation. According to the equation, the ratio of efficiency change over overall boiler efficiency equals the time factor since the last sootblowing operation times the parameter minus a summation of factors for each of the other heat traps and their associated sootblowing operations. A method is also disclosed for enhancing a sootblowing operation wherein, with a plurality of heat traps, sootblowing is performed in an upstream heat trap in preference to a downstream heat trap, when both heat traps are near a fouled condition which would require sootblowing. This prevents premature fouling of a downstream heat trap which has recently been cleaned by soot blown off an upstream heat trap.

2 Claims, 7 Drawing Figures

ENHANCED SOOTBLOWING SYSTEM

FIELD AND BACKGROUND OF THE INVENTION

The present invention relates, in general, to fossil fuel boilers and in particular to a new and useful method and arrangement for optimizing scheduled timing of sootblowing in such boilers.

The combustion of fossil fuels for the production of steam or power, generates a residue broadly known as ash. All but a few fuels have solid residues, and in some instances, the quantity is considerable.

For continuous operation, removal of ash is essential. In suspension firing the ash particles are carried out of the boiler furnace by the gas stream and form deposits on tubes in the gas passes (fouling). Under some circumstances, the deposits may lead to corrosion of these surfaces.

Some means must be provided to remove the ash from the boiler surfaces since ash in its various forms may seriously interfere with operation or even cause shutdown. Furnace wall and convection-pass surfaces can be cleaned of ash and slag while in operation by the use of sootblowers using steam or air as a blowing medium. The sootblowing equipment directs product air through retractable nozzles aimed at the areas where deposits accumulate. The convection-pass surfaces in the boiler, sometimes referred to as heat traps, are divided into distinct sections in the boiler, e.g. superheater, reheater and economizer sections. Each heat trap normally has its own dedicated set of sootblowing equipment. Usually, only one set of sootblowers is operated at any time, since the sootblowing operation consumes product steam and at the same time reduces the heat transfer rate of the heat trap being cleaned.

Scheduling and sequencing of sootblowing is usually implemented with timers. The timing schedule is developed during initial operation and startup of the boiler. In addition to timers, critical operating parameters, such as gas side differential pressure, will interrupt the timing schedule when emergency plugging or fouling conditions are detected.

The sequencing, scheduling and optimizing of the sootblowing operation can be automated by using controls. See U.S. patent application Ser. No. 405,840 filed Aug. 4, 1982 and entitled, SOOTBLOWING OPTIMIZATION, which is here incorporated by reference.

The scheduling is usually set by boiler cleaning experts who observe boiler operating conditions and review fuel analyses and previous laboratory tests of fuel fouling. The sootblower schedule control settings may be accurate for the given operating conditions which were observed, but the combustion process is highly variable. There are constant and seasonal changes in load demand and gradual long term changes in burner efficiency and heat exchange surface cleanliness after sootblowing. Fuel properties can also vary for fuels such as bark, refuse, blast furnace gas, residue oils, waste sludge, or blends of coals. As a result, sootblowing scheduling based on several days of operating cycles may not result in the most economical or effective operation of the boiler. Present practice for sootblowing scheduling is based on the use of timers. The timing schedule is developed during initial operation and startup, and according to the above application, can be economically optimized for constant and seasonal changes in load demand, fuel variations, and gradual long term changes in burner efficiency and heat exchange surface cleanliness after sootblowing.

A boiler diagnostic package which can be used for sootblowing optimization has been proposed by T. C. Heil et al in an article entitled "Boiler Heat Transfer Model for Operator Diagnostic Information" given at the ASME/IEEE Power Gen. Conference in October 1981 at St. Louis, Mo. The method depends upon estimates of gas side temperatures from coupled energy balances, and the implementation requires extensive recursive computations to solve a series of heat trap equations.

As noted, various approaches have been developed to optimize the use of sootblowing equipment. One known method computes optimum sootblowing schedules using a model of boiler fouling characteristics which is adapted on-line. An identification of the rate of total boiler efficiency versus time ("fouling rate") is computed for multiple groupings of sootblowers in the various heat traps, of sootblowers using only a measure of relative boiler efficiency. Using this information, the economic optimum cycle times for sootblower operation are predicted.

For the above scheme and others similar to it, a critical part of the computation is the identification of the "fouling rates". A major problem in this identification is the interaction of the effects due to multiple heat trap operations. Some methods have assumed these effects to be negligible in their scheme, while other methods require a large number of additional inputs attempting to account for these instructions. For some combustion units with sootblowers, neglecting multiple heat trap interactions is valid (i.e., utility boilers). However, for many units sootblowing is a continuous procedure and a method of accounting for the interactions is necessary. This method should be implemented without adding a large number of expensive inputs.

SUMMARY OF THE INVENTION

An object of the present invention is to provide a method and means of identifying the "fouling rate" of multiple sootblower groups for all types of combustion units. The identification can be done using combinations of "fouling rate" models for different heat traps, as well as being applied to methods in which only one model type is assumed.

According to the invention, the identification is accomplished using only a relative boiler efficiency measurement, and does not require additional temperature inputs from throughout the boiler. Also, the implementation of this invention can be accomplished in microprocessor-based equipment such as the NETWORK 90 controller module. (NETWORK 90 is a trademark of the Bailey Controls division of Babcock and Wilcox, a McDermott company.)

Another object of the invention is to provide a method of identifying a parameter of a model for a rate of loss of boiler efficiency due to a sootblowing operation in one of a plurality of heat traps in a boiler which comprises measuring the time since a last sootblowing operation in the heat trap in question, measuring an overall boiler efficiency at a beginning of the sootblowing operation for that heat trap, the overall boiler efficiency being due to all heat traps present, measuring the change in efficiency in the boiler due to the sootblowing operation in the heat trap in question and calculating the parameter using an equation which relates the change in efficiency due to a particular sootblowing operation, to the overall efficiency of the boiler.

A further object of the invention is to improve upon the sootblowing optimization of the above-identified application by initiating sootblowing operations, wherever possible, in upstream one of the heat traps so that a heat trap which has just undergone cleansing by sootblowing, is not fouled by soot blown off an upstream heat trap when the upstream heat trap undergoes sootblowing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
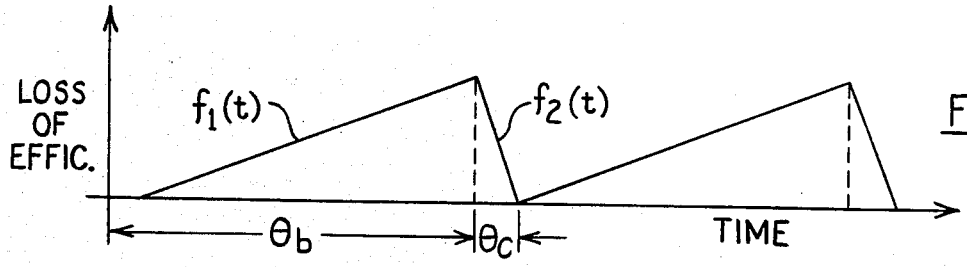
FIG. 1 is a graph (linearized) showing loss of efficiency due to fouling plotted against time and illustrating the effect of a sootblowing operation in a single heat trap of a boiler.

Referring to the drawings in particular, the invention provides for a method of calculating or identifying parameters of multiple models for the rate of loss of total boiler efficiency due to the cleaning of individual heat traps of the boiler by a sootblowing operation.

In a boiler (not illustrated) a plurality of heat traps are usually provided which lie in series with respect to a flow of combustion gases. For example, immediately above a combustion chamber, platens are provided which are followed, in the flow direction of the combustion gases, by a secondary superheater, a reheater, a primary superheater and an economizer. Continuing in the flow direction, the flow gases are then processed for pollution control and discharged from a stack or the like.

Each heat trap is provided with its own sootblowing equipment so that the heat traps can be cleaned by sootblowing at spaced times while the boiler continues to operate. Each sootblowing operation, however, has an adverse effect on the overall efficiency of the boiler, during the sootblowing operation proper. The sootblowing operation, by reducing fouling, ultimately increases the efficiency of the particular heat trap being serviced.

As shown in FIG. 1, fouling rate models can be established which share the loss of efficiency over a period of time after a sootblowing operation, as the heat trap becomes fouled. The symbol $\theta_b$ is the time since the sootblower last ran in a boiler having only a single heat trap. The time $\theta_c$ is the time during which the sootblowing operation takes place. The loss of efficiency since the last sootblowing operation is a function of time as is the change in efficiency (increase) during the sootblowing operation. These functions for these two periods can be written as follows:

$$f_1(t)=a_1\theta_b^N$$

$$f_2(t)-b_1\theta_c$$

where $a_1$ and $b_1$ are model parameters and N=a coefficient for the fouling rate model.

This coefficient and the model itself can be of the type discussed in the Heil et al article.

While these functions are illustrated as being linear, they need not be so.

Figure 2:
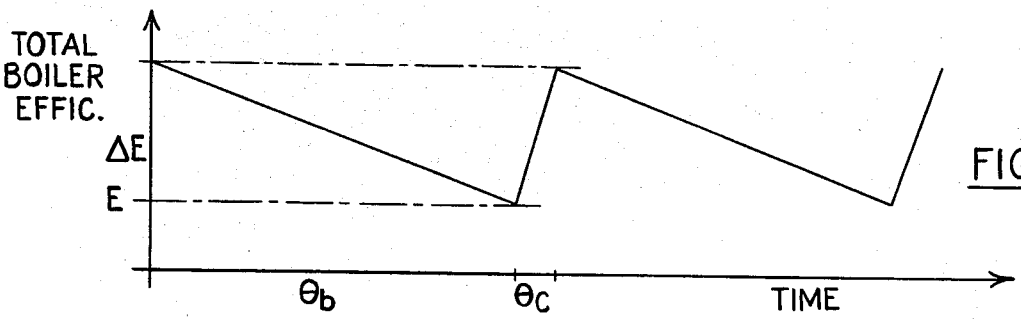
FIG. 2 is a graph (linearized) showing the change in overall boiler efficiency plotted against time during fouling and sootblowing operations in a single heat trap.

For a boiler having only one heat trap, the identification of the adjustable model variable $a_1$ is easily done. By simply measuring the change in total boiler efficiency due to sootblowing, the model can be evaluated as shown in FIG. 2 and in accordance with the relationship:

$$a_1 = -\frac{\Delta E_1}{E\theta_b^N}$$

where $\Delta E_1$ is the change of overall boiler efficiency due to a sootblowing operation and E is the overall boiler efficiency since the beginning of the last sootblowing operation.

For systems with multiple heat traps however, the identification of the various parameters $a_1$, for the various heat traps in the models become difficult. One known method assumes, for a system in which the time for sootblowing is much less than times at which no sootblowing takes place, the identification method can be the same as for a single heat trap. For systems in which this is not the case, however, a more involved calculation must be used.

Figure 3:
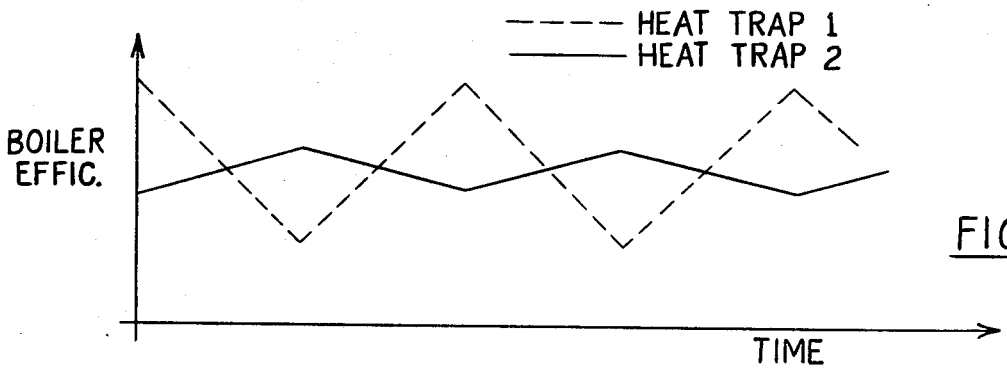
FIG. 3 is a graph (linearized) showing boiler efficiency plotted against time for two separate heat traps.
Figure 4:
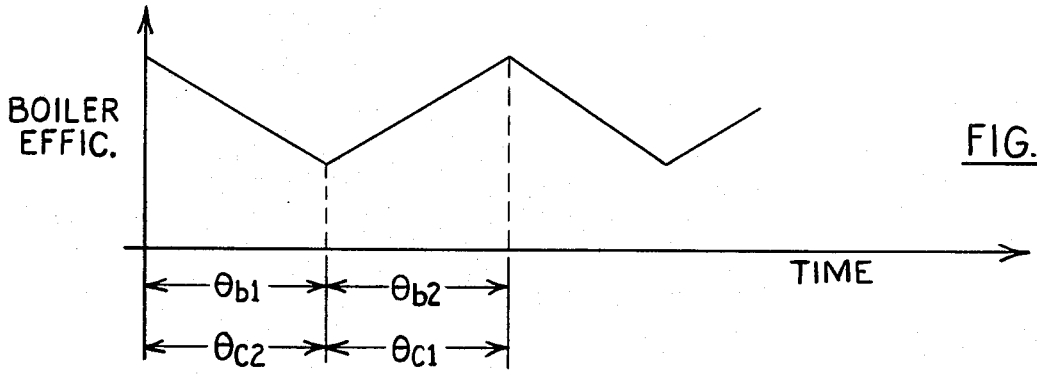
FIG. 4 is a graph (linearized) showing the overall efficiency of the boiler of FIG. 3 which includes two heat traps.

FIG. 3 illustrates the case where two heat traps are provided and shows the effect of boiler efficiency due to these two traps separately. From outside the boiler however, where the overall efficiency is measured, a composite curve is observed as illustrated in FIG. 4. The parameters $a_1$ for the $i^{th}$ heat trap, in the model, can be calculated from measuring this change and overall efficiency. The relationships for two heat traps with linear fouling models can be written:

$$-\Delta E_1/E=a_1\theta_{b1}-a_2\theta_{c2}$$

$$-\Delta E_2/E=a_1\theta_{c2}-a_2\theta_{b2}$$

where $\Delta E_2$ is the change in efficiency due to sootblowing in the second heat trap $\theta_{c2}$ is the time for sootblowing in the second heat trap and $\theta_{b2}$ is the time since the last sootblowing in the second heat trap.

These various periods of time are illustrated in FIG. 4.

It is noted that the parameter $a_2$ is negative which implies the cleaning of the second heat trap leads to a decrease in boiler efficiency. In reality, the decrease in boiler efficiency due to the fouling of the first heat trap offsets the cleaning of the second heat trap.

Figure 5:
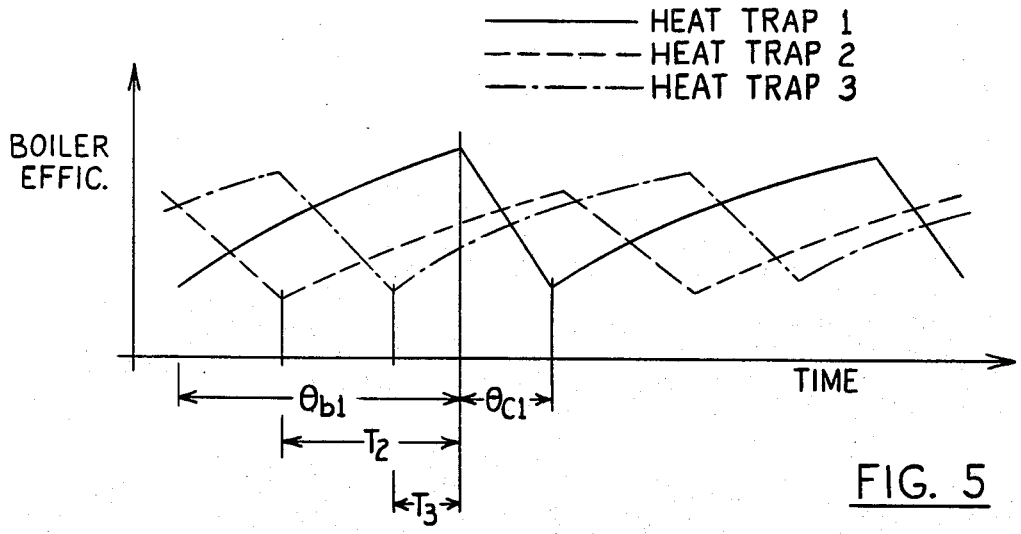
FIG. 5 is a graph plotting loss of efficiency against time for three heat traps in a boiler.

The fouling model for a boiler having three heat traps is illustrated in FIG. 5. The above analysis can be expanded and generalized by any number of heat traps with variable model types and m heat traps as follows:

$$-\Delta E_i/E = a_i\theta_{bi}^{Ni} - \sum_{\substack{j=1\\ j\neq i}}^{m} a_j((T_j + \theta_{ci})^{Nj} - T_j^{Nj}$$

Where $\Delta E_i$ is the change in efficiency due to sootblowing in the $i^{th}$ heat trap and j is not equal to i (that is, a heat trap other than the heat trap for which the parameters $a_i$ is being calculated) and $T_j$ is the time since sootblowing in the $j^{th}$ heat trap.

For three traps therefore as shown in FIG. 5, the equation becomes:

$$-\Delta E_1/E = a_1\theta_{b1}^{N1} - ((T_2+\theta_{c1})^{N2} - T_2^{N2})a_2 - ((T_3 + \theta_{c1})^{N3} - T_3^{N3})a_3$$

The method of the present invention can be implemented using the NETWORK 90 as a microprocessor for effecting the various required steps and manipulations.

Figure 6:
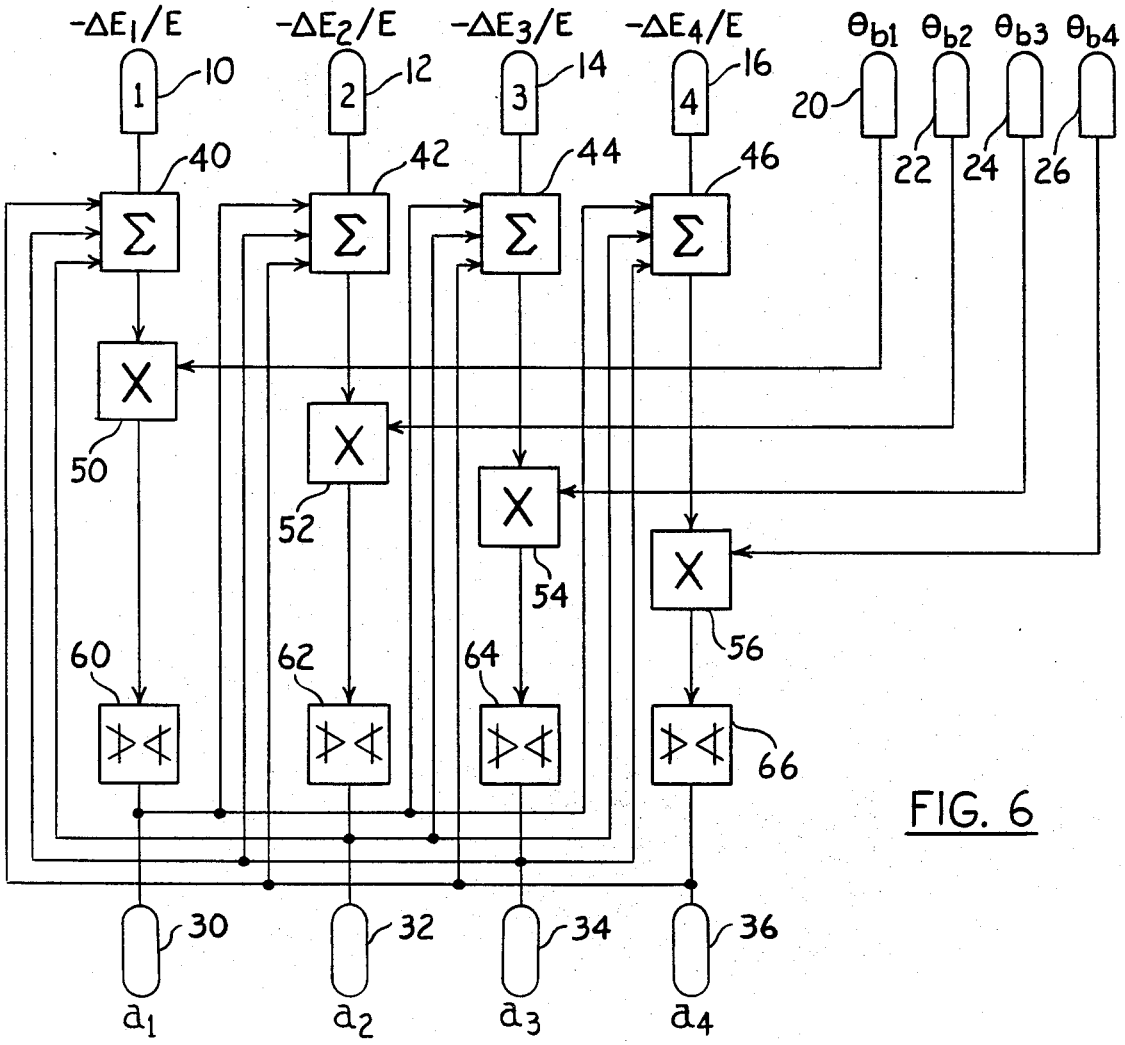
FIG. 6 is a block diagram illustrating how the method of the invention can be implemented.

As shown in FIG. 6, conventional equipment such as temperature and oxygen sensors can be utilized to establish the ratio $\Delta E_i/E$ in units 10, 12, 14 and 16, for each of four heat traps where i=1, 2, 3, or 4. Suitable sensors and timers (not shown) can also be utilized to determine the times since last sootblowing in each heat trap, as illustrated at units 20, 22, 24 and 26.

At the output of the operating logic circuit illustrated in FIG. 6, the model parameters $a_1$, $a_2$, $a_3$ and $a_4$, are generated at output units 30, 32, 34, and 36.

The logic circuit includes summing units 40, 42, 44 and 46 which receive the output of the respective efficiency units 10 through 16 and sum these outputs to a factor from each of the other heat traps. The output of summing units 40 through 46 are multiplied by the appropriate time period for the respective heat traps in multiplication units 50, 52, 54, and 56. Limiters 60, 62, 64, and 66 are then provided to generate the parameter information and the factor to be added in the summing unit of each other heat trap.

Parameter identification as set forth above can be utilized to optimize the sootblowing operation for each heat trap in accordance with the above-identified application for sootblowing optimization.

According to that application, a set value for the time $\theta_b$ between sootblowing operations is compared to an optimum value $\theta_{opt}$. The optimum cycle value $\theta_{opt}$ is attained as a function, not only of fouling and lost efficiency, but also a cost factor for the sootblowing operation. While the optimum cycle time cannot be calculated directly, a formula is provided which can be utilized to determine the optimum cycle time using conventional trial and error techniques such as Regula-Falsi and Newton-Raphson. The formula for obtaining the optimum cycle time is as follows:

$$O = P\ln\left[\frac{P + \theta_{opt}}{P}\right] - \frac{P(\theta_{opt} + \theta_c)}{\theta_{opt} + P} - \frac{S}{K} + \theta_c$$

where $O_c$ is the actual sootblowing time, S is the cost of steam for sootblowing and K and P are scaling parameters, K being a function of flow rate of fluid in the boiler and P being a function of K, and incremental steam cost and the cycle time between sootblowing operations.

According to the above-identified application, three conditions were to be met before sootblowing operation in one of a plurality of heat traps was initiated. These conditions were:

(a) no other sootblower is currently active (b) the difference between set and optimum cycle time ($\theta_b - \theta_{opt}$) is sufficiently low and (c) if condition (b) exists for more than one heat trap, the heat trap at the lowest value is chosen.

According to the invention, a fourth condition is added as follows:

(d) if condition (c) exists, a sootblowing operation for a downstream one of the heat traps is delayed until an upstream one of the heat traps undergoes sootblowing.

By observing this fourth condition, a newly-cleaned downstream heat trap is not prematurely fouled by ash blown from an upstream heat trap.

Figure 7:
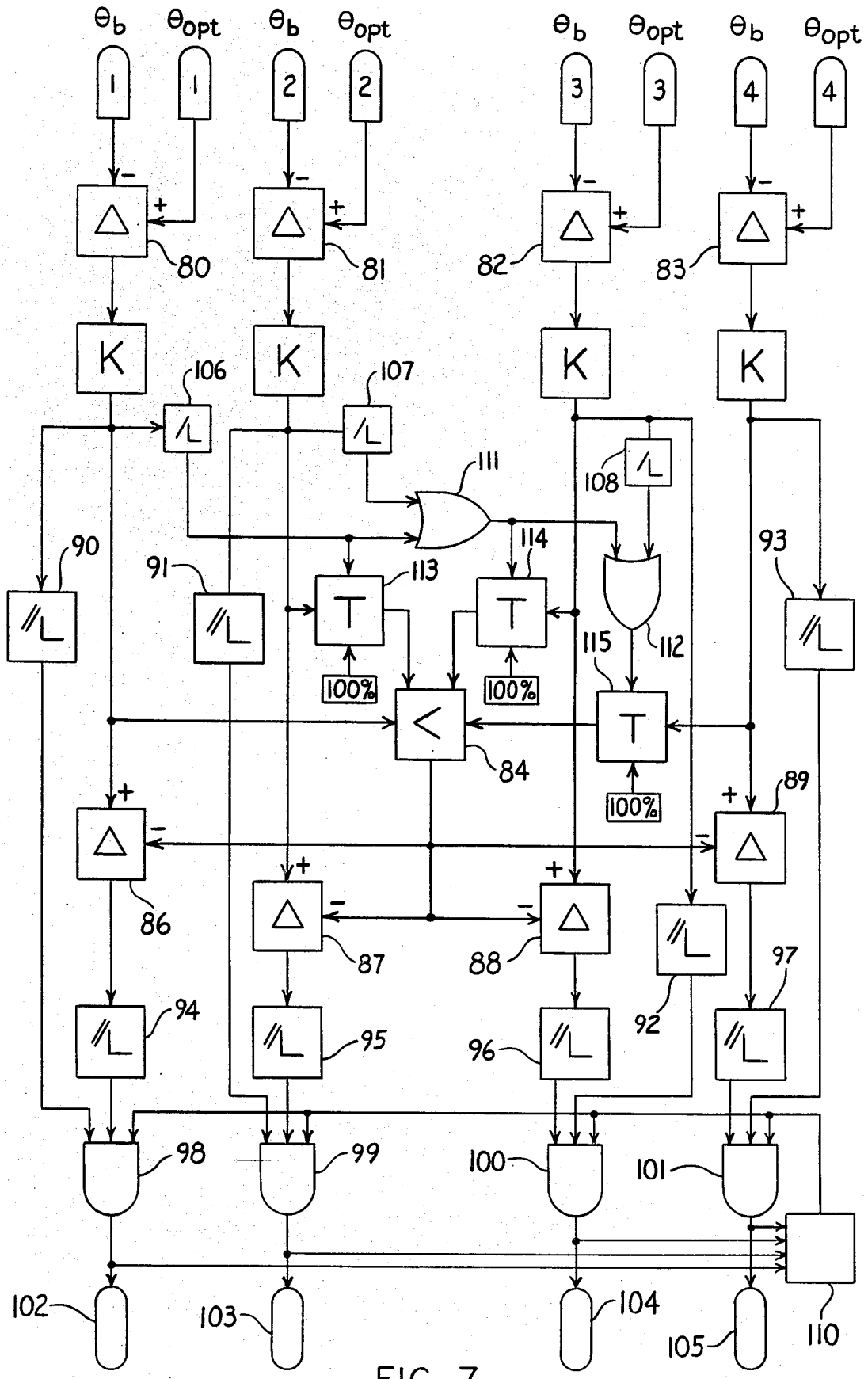
FIG. 7 is a block diagram illustrating how an optimizing scheme for optimizing sootblowing can be further improved by selecting an upstream heat trap for sootblowing when more than one heat traps are candidate for sootblowing at the same time.

Referring to FIG. 7, the set and optimum cycle values $\theta_b$ and $\theta_{opt}$ from four heat traps, numbered 1 through 4 are shown. Comparators 80 to 83 obtain a difference between the optimum and set cycle times, with comparator 84 choosing the smallest difference.

Comparators 86 through 89 as well as low limit detectors 90 through 97 are utilized. AND gates 98 through 101 compare Boolean logic signals and only the AND gate with all positive inputs is activated to operate its respective sootblowing equipment which is connected to control elements 102 through 105 respectively. Sensing unit 110 establishes condition (a) by sensing whether any other blower is currently active. If no other blower is active, an on or one signal is provided to one of the three inputs of the AND gates 98 through 101.

Condition (b) is established by low limit detectors 90 through 93 with condition (c) being established by low limit detectors 94 through 97.

In FIG. 7, the heat trap designated 1 is considered the upstream most heat trap with the heat traps following in sequence to the last or downstream heat trap 4.

Additional low limit detectors 106, 107, and 108 are connected to the output lines of the first, second, and third heat traps and through OR gates 111 and 112 to to transfer units 114 and 115.

An additional transfer unit 113 is connected to the output of low limit detector 106. In this manner, if all but the upstream most heat trap (1) is to have sootblowing initiated, its operation is delayed until an upstream one of the heat traps undergoes sootblowing, when that uppermost heat trap is sufficiently near its sootblowing time. Thus condition (d) is established and a freshly cleaned heat trap is not prematurely fouled by ash blown off an upstream heat trap.

While specific embodiments of the invention have been shown and described in detail to illustrate the application of the principles of the invention, it will be understood that the invention may be embodied otherwise without departing from such principles.

I claim:

1. A method of optimizing a sootblowing operation in a boiler having a plurality of heat traps lying in series along a gas flow path, comprising:

selecting a set time ($\theta_{bi}$) between sootblowing operations of each heat trap based on a fouling model for the boiler;

calculating an optimum time ($\theta_{opt}$) between sootblowing operations of each heat trap based on scaling parameters and a cost factor for the sootblowing operation;

obtaining a difference value between set and operating time for each heat trap comparing the difference value for each heat trap with a selected value which is indicative of the desirability for initiating a sootblowing operation for each heat trap;

with the difference value equaling the selected value for only one heat trap, initiating sootblowing in that one heat trap;

with the difference value approaching the selected value for more than heat trap, delaying the initiation of sootblowing in a downstream one of the heat traps to permit the difference value to equal the selected value in an upstream one of the heat traps to initiate sootblowing in the upstream one of the heat traps before the initiation of sootblowing in a downstream one of the heat traps.

2. A method according to claim 1, including initiating sootblowing in a heat trap only when sootblowing is not taking place in any other heat trap.

* * * * *